US008844813B2

(12) United States Patent
Korb et al.

(10) Patent No.: US 8,844,813 B2
(45) Date of Patent: Sep. 30, 2014

(54) ELECTRONIC CORRECTION OF VOTER-MARKED PAPER BALLOT

(75) Inventors: Lawrence Korb, Moraga, CA (US); James Hoover, Outremont (CA)

(73) Assignee: Dominion Voting Systems, Inc., Denver, CO (US)

( * ) Notice: Subject to any disclaimer, the term of this patent is extended or adjusted under 35 U.S.C. 154(b) by 198 days.

(21) Appl. No.: 13/476,836

(22) Filed: May 21, 2012

(65) Prior Publication Data

US 2013/0306724 A1 Nov. 21, 2013

(51) Int. Cl.
*G07C 13/00* (2006.01)

(52) U.S. Cl.
USPC ..... 235/386; 235/51; 235/454

(58) Field of Classification Search
CPC .. G07C 13/00; G07C 13/005; G06K 17/0032; G06K 7/1447; G06K 7/1443; G06K 7/1469; G06K 7/1439
USPC ..... 235/386, 51, 454
See application file for complete search history.

(56) References Cited

U.S. PATENT DOCUMENTS

2005/0247783 A1* 11/2005 Poulos et al. ..... 235/386
2006/0202031 A1 9/2006 Chung et al.
2008/0308634 A1 12/2008 Bolton

* cited by examiner

*Primary Examiner* — Kristy A Haupt
(74) *Attorney, Agent, or Firm* — Holland & Hart LLP

(57) ABSTRACT

Methods, systems, and devices are described for electronically correcting votes made on voter-marked paper ballots. An optical scan system may image a paper ballot and allow vote modification by the voter following the imaging. Such a modification may be necessary, for example, if a voter has improperly voted (e.g., voted for two candidates for one office), if a definitive determination of the intention to cast a vote cannot be made (e.g., partially filed-in bubble associated with a candidate, erasure, stray marks), if a write-in candidate is included on the ballot, or if a voter has changed their mind or otherwise wishes to cast a different vote than initially indicated. After correction, the corrected ballot may be re-imaged.

38 Claims, 15 Drawing Sheets

300

700

DRO: 2109

Office Of Mayor: 0,0,1,0,0,0,0,0,0,0,0,0,0,0,0,78D
Vote for: AMBIGUOUS
VOTER CONFIRMED Vote for: Jacques CARTIER Office of Councillor (800,0) (1,790), (0,0)
Vote for: Miles J. MASSEY (1st), Menelaus P. O'DANIEL (2nd)

Office of Alderman: 2,812,2,823,788,774
Vote for: OVER-VOTE
VOTER CONFIRMED Vote for: Jeanne MANCE (1), Nellie McCLUNG (2), Mary PICKFORD (3)

805

800

900

DRO: 2109

Office Of Mayor: 0,0,1,0,0,0,0,0,0,0,0,0,0,0,0,78D
Vote for: WRITE-IN
VOTER CONFIRMED vote for: Peter F. JONES Office of Councillor (800,0) (1,790), (0,0)
Vote for: Miles J. MASSEY (1st), Menelaus P. O'DANIEL (2nd)

Office of Alderman: 2,812,2,823,788,774
Vote for: Jeanne MANCE (1) , Nellie McCLUNG (2) , Mary PICKFORD (3)

1015

1000

1100

ELECTRONIC CORRECTION OF VOTER-MARKED PAPER BALLOT

BACKGROUND

The present invention relates to optical scan voting systems in general and, in particular, to optical scan voting systems including methods and systems for electronically modifying and/or confirming votes in voter-marked paper ballots.

Electronic tabulation of voter-marked paper ballots has been used in elections for some time. Such systems may provide efficient vote tabulation if ballots are received without any errors, modifications, or write-in candidates included on the ballot. Such systems may operate through a voter completing a ballot and returning the completed ballot to, for example, a ballot reader for tabulation. In some instances the ballot may not be filled out correctly. Some ballots may also include a write-in candidate's name added by the voter. Such instances may consume election official resources at the polling place or later. Furthermore, an improperly completed ballot may result in a vote not being counted where; in fact, the voter had desired to cast a vote.

Improperly completed ballots may result from a number of circumstances. For example, a voter may vote for two different candidates for a particular office. If such an error is discovered at the polling place, the voter may ask a poll worker to obtain a replacement ballot, which may then be completed. Such a process can be time consuming for both the poll worker and the voter, as specific procedures may be set out for voiding the original ballot and issuing a replacement ballot. In addition, improperly completed ballots may also include voter response marks that may not be properly tabulated by an electronic tabulating system due to, for example, a voter not completely filling in a bubble indicating a vote, and/or attempting to erase or otherwise cross-out a mark. Each of these cases may result in a ballot that may not be properly counted by the system, and may result in a vote not being counted where; in fact, the voter had desired to cast a vote.

Additionally, as mentioned, some voters may choose to write-in a candidate's name for a particular office. Such ballots may include write-in votes in which the names may not be spelled correctly, or handwriting may be illegible. Such situations may result in a ballot that may not be properly counted by the system, and may result in a vote not being counted where; in fact, the voter had desired to cast a vote.

SUMMARY

Methods, systems, and devices are described for electronically correcting votes made on voter-marked paper ballots. According to some embodiments, an optical scan system is provided in which a paper ballot is imaged and allowed to be modified by the voter following the imaging. Such a modification may be necessary, for example, if a voter has improperly voted (e.g., voted for two candidates for one office), if a definitive determination of the intention to cast a vote cannot be made (e.g., partially filled-in bubble associated with a candidate, erasure, stray marks), if a write-in candidate is included on the ballot, if a voter has changed their mind or otherwise wishes to cast a different vote than initially indicated, or if one or more vote selections are not made on the ballot.

According to one set of embodiments, a ballot counting system may receive input from the voter to modify an existing ballot. In some embodiments, a voter takes a completed ballot to an optical scan system, and feeds the ballot into a ballot-entry slot. The results of the tabulation may be displayed or otherwise provided to the voter, and a confirmation may be received that the tabulation is correct. In the event of an error reading the ballot, or an improper vote has been detected (e.g., two votes for one office), the voter may be prompted to provide information to clarify one or more votes, such as by confirming or correcting the vote(s). When confirming or correcting vote information, the voter may also provide an input indicating that a particular vote is to be changed. The system may receive the corrected or modified vote, and record the vote in a cast vote record while the voter is still present at the system. In some embodiments, modifications may be printed on the ballot and/or electronically recorded in the cast vote record.

Additionally, some voters may elect to write-in a candidate's name for a particular office. Another set of embodiments provides a ballot counting system may receive input from the voter to confirm a write-in candidate vote. In some embodiments, a voter takes a completed ballot to an optical scan system, and feeds the ballot into a ballot-entry slot. The results of the tabulation may be displayed or otherwise provided to the voter, and a confirmation may be received that the tabulation is correct. In the event that a write-in vote is detected, the voter may be prompted to provide vote clarification that may include confirmation of the write-in vote and write-in candidate selected. The confirmation may include, for example, correct spelling of the write-in candidate's name. The system may receive the corrected or modified vote, and record the vote in a cast vote record while the voter is still present at the system. In some embodiments, write-in candidate information may be printed on the ballot and/or electronically recorded in the cast vote record.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
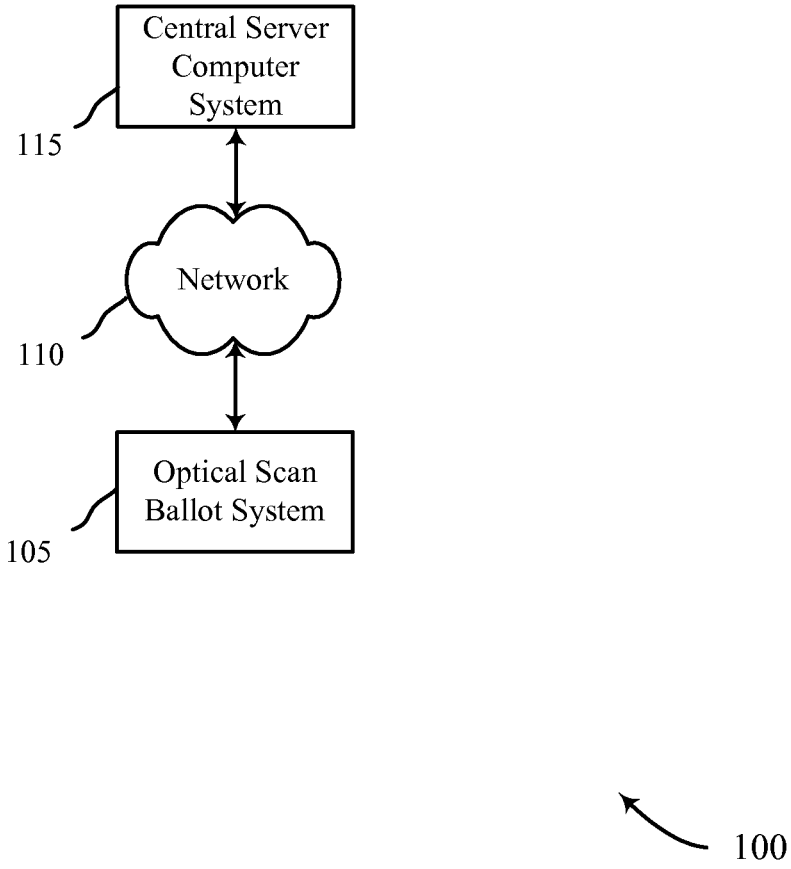
FIG. 1 is a block diagram of an optical scan based ballot tabulation system including components configured according to various embodiments.

Methods, systems, and devices are described for electronically correcting votes made on voter-marked paper ballots. In some embodiments, an optical scan system is provided in which a paper ballot is scanned or otherwise optically imaged and allowed to be modified by the voter following the scan. Such a modification may be necessary if a voter has improperly voted (i.e., voted for two candidates for one office), if a definitive determination of the intention to cast a vote cannot be made due to, for example, a partially filed-in selection area associated with a candidate, an erasure, stray marks, etc., if a voter has changed their mind or otherwise wishes to cast a different vote than initially indicated, if a write-in candidate is detected on the ballot, and/or if one or more vote selections are not made on the ballot. As discussed, some of these cases could result in the original ballot being voided and the voter given a new ballot. This is a resource intensive process, and also time consuming for the voter. Furthermore, destroying a ballot introduces chain-of-custody issues for the invalid ballots. Various embodiments describe systems and methods for a voter to electronically confirm, clarify, or modify a ballot electronically without the need to complete a replacement ballot.

Additionally, as mentioned, some voters may elect to write-in a candidate's name for a particular office. In some embodiments, an optical scan system is provided in which a paper ballot is scanned or otherwise optically imaged and write-in votes are confirmed or otherwise modified by the voter following the scan. Write-in votes may be cast in an optical scan ballot through a target area that is to be marked to indicate the voter has selected to write-in a candidate, and a line is provided for the voter to write the name of the candidate. Capturing these write-in votes may consume a significant amount of resources for election officials, as these votes may need to be reviewed by a human. Furthermore, names may not be spelled correctly, or handwriting may be illegible, which may result in votes not being counted. Additionally, issues may arise when a voter writes a name on a line of the ballot, but has not marked the target area, or where a voter has selected one of the printed candidates and has also written in the write-in area. Various embodiments describe systems and methods for a voter to electronically confirm, clarify, or modify a write-in candidate electronically.

This description provides examples, and is not intended to limit the scope, applicability or configuration of the invention. Rather, the ensuing description will provide those skilled in the art with an enabling description for implementing embodiments of the invention. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

One category of electronic voting systems, referred to herein as optical scan systems, receive a paper ballot that has been marked by a voter. The paper ballot is scanned or otherwise imaged to generate an optical image of the ballot, with the optical image then analyzed by analysis software to determine votes that are cast by the ballot. Another category of electronic voting systems, referred to as direct recording electronic (DRE) systems, record votes through a ballot display provided with mechanical or electro-optical components that may be activated by the voter (typically buttons or a touch-screen). In both categories of systems, a tabulation of the voting data is performed, either through a precinct counts provided to a central location, and/or through tabulation performed at a central location.

In DRE systems, errors on ballots are limited, as such systems generally do not allow over-votes and incomplete or incorrect voter markings are not encountered due to binary input from the user interface of the DRE system. Furthermore, write-in candidate names are typed in or selected through some electronic input, thus providing readily legible write-in names. In optical scan voting systems, where a voter marks a paper ballot, errors may be encountered in such instances. For example, an optical scan tabulation system may not record a vote for a particular candidate because a box or bubble next to the candidate's name may not be completely filled in. An election official reviewing such a ballot may readily conclude that the voter intended to cast a vote for the particular candidate, and that the optical scan tabulation system simply did not tabulate the vote because the mark for the candidate did not register as a vote for the candidate. In some situations, however, the intent of the voter may not be clear, and thus a vote may not be counted, or an incorrect vote may be counted. Of course, such instances are not desirable, and aspects of the present disclosure provide systems and methods to receive a confirmation of the voter intent from the voter themselves, while the voter is at the system. This confirmation of voter intent may be included in a cast vote record for the ballot, which is used in tallying election results.

With reference now to FIG. 1, a block diagram of a ballot scanning and tabulation, system 100 according to some embodiments is described. In the system 100 of FIG. 1, an optical scan ballot system 105 is configured to receive voter-marked paper ballots, scan the ballots, and provide an optical image of the voter marked paper ballots. The optical scan ballot system 105 may include any of several types of scanning equipment, and in an embodiment includes a feeding mechanism that receives ballots and feeds the ballots through a scanner and then into a ballot box. In some embodiments, the optical scan ballot system 105 includes a printer that may mark scanned ballots with one or more marks that may be used to identify the paper ballot. In other embodiments, the optical scan ballot system 105 evaluates marks on the ballots and determines votes made by the voter. The voter may be prompted to clarify the votes determined by the optical scan ballot system 105. In the event that one or more vote(s) satisfy a criteria for voter clarification, the voter may be prompted to provide clarification while the voter is still present at the optical scan ballot system 105. The criteria for voter clarification, as will be described in more detail below, may include marginal or ambiguous marks, over votes, under votes, and/or write-in votes, for example. In some cases, a voter may provide a blank ballot, in which case the voter may be prompted to provide all votes for the ballot. In response to being prompted for clarification, the voter may provide one or more clarifications, such as corrections, confirmations, or modifications of votes. Thus, as used herein, the term "clarification" may include any vote clarifying action, such as corrections, confirmations, or modifications. These clarified votes may be stored in a cast vote record for tabulation to determine election outcome. In some embodiments, confirmed and/or clarified votes may be printed on the ballots by the optical scan ballot system 105 using an internal printer. An optical image of the ballot is obtained by the optical scan ballot system 105, and in some embodiments the vote outcomes determined by the optical scan ballot system 105 are included as an audit mark in the optical image. Such an optical image may then be viewed by other systems to display the optical image of the voter-marked paper ballot along with the audit mark provided by the optical scan ballot system 105. Examples of optical scan ballot systems 105 will be described in more detail below.

The optical scan ballot system 105 of FIG. 1 may be connected through a network 110 to a central server computer system 115. Central server computer system 115 may receive cast vote record data from optical scan ballot system 105, and tally votes to determine election results. In some embodiments, a number of optical scan ballot systems 105 are included at a number of different precinct locations. In such cases, each optical scan ballot system may provide a tally of vote outcomes for the particular precinct. In other embodiments, each optical scan ballot system 105 may simply provide cast vote record information to the central server computer system 115. In some embodiments, the central server computer system 115, may receive data containing the optical images of paper ballots and audit marks, if provided, from the optical scan ballot system 105. In some embodiments, the central server computer system 115 may include, as part of the central server computer system 115 or separately, an adjudication system that may allow an election official to review optical images of the paper ballots, and, based on the review, make a determination as to whether the marks were properly counted as votes or whether changes should be made to properly record the votes on the paper ballot. In some embodiments, an audit mark is viewable along with the image of the paper ballot allowing the review of votes recognized by the optical scan ballot system and comparison with the marks on the paper ballot.

Figure 2:
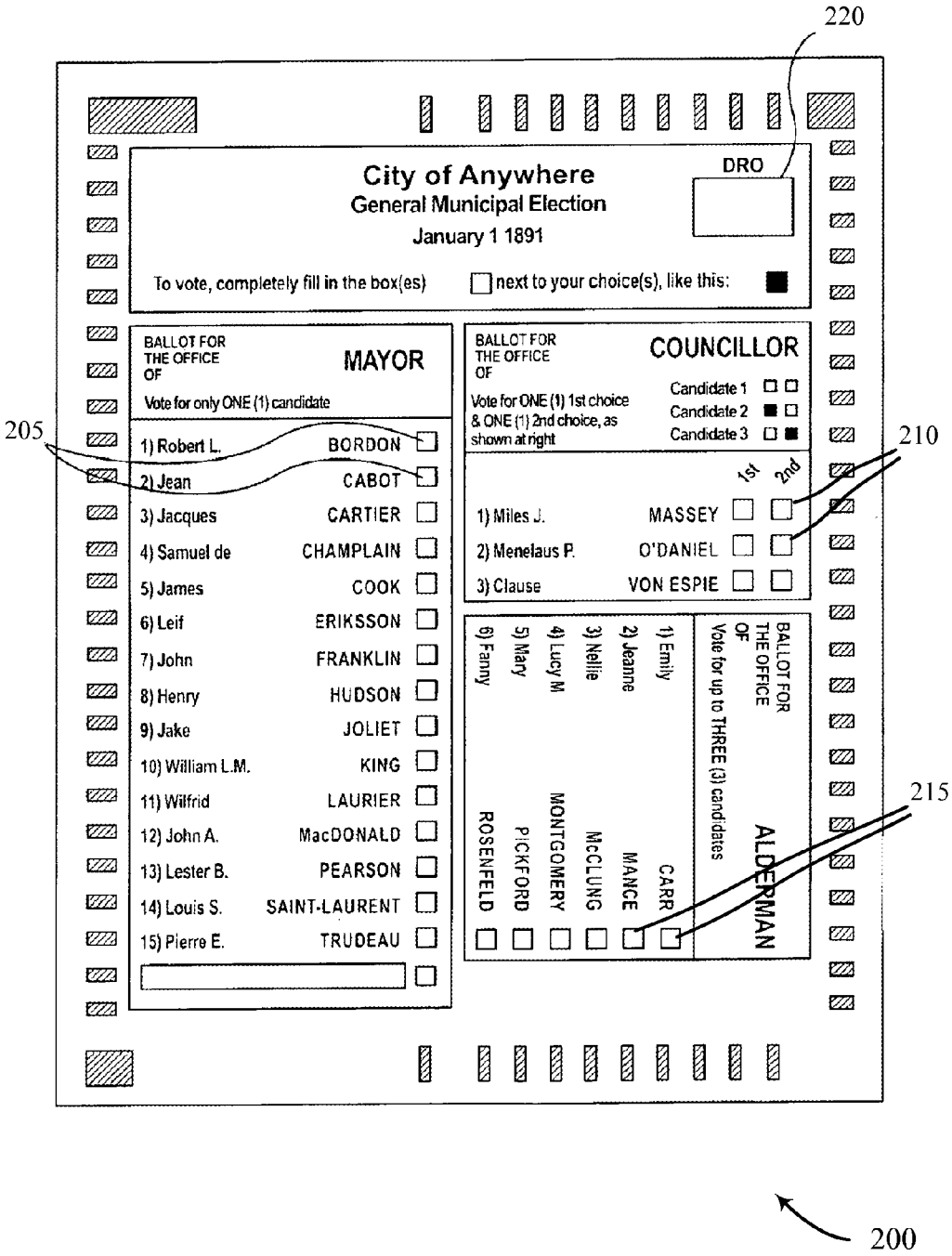
FIG. 2 is an image of a paper ballot according to various embodiments.

With reference now FIG. 2, an example of a paper ballot 200 is described. The ballot 200 includes a number of voter selection areas 205, 210, 215 that represent voter selections for different offices or ballot questions. In the example ballot 200, there is also an election official area 220, which commonly appears in ballots, that is used by the election official to validate the particular ballot. The validation may take the form of a signature or initials in the election official area 220 by the election official, however, other types of authentication may also be used. The election official area 220 may serve to mark the paper ballot 200 as having been officially issued. It will be readily understood that paper ballots such as ballot 200 may include pre-printed ballots and/or ballots printed locally on-demand by a local printer. The voter may take the validated blank paper ballot 200 to a private area (such as a desk with privacy barriers), and make a mark or marks (this can be done in numerous ways such as filling in a box, making an 'X', etc) beside the chosen candidate(s) with a marking instrument. For the sake of clarity, this disclosure generally refers to selection of a candidate or candidates, however, some votes relate to other questions such as referendum questions, ballot initiatives, and the like. The concepts described herein extend to votes obtained all matters whether candidates, weighted candidate votes, referendum questions and the like.

Figure 3:
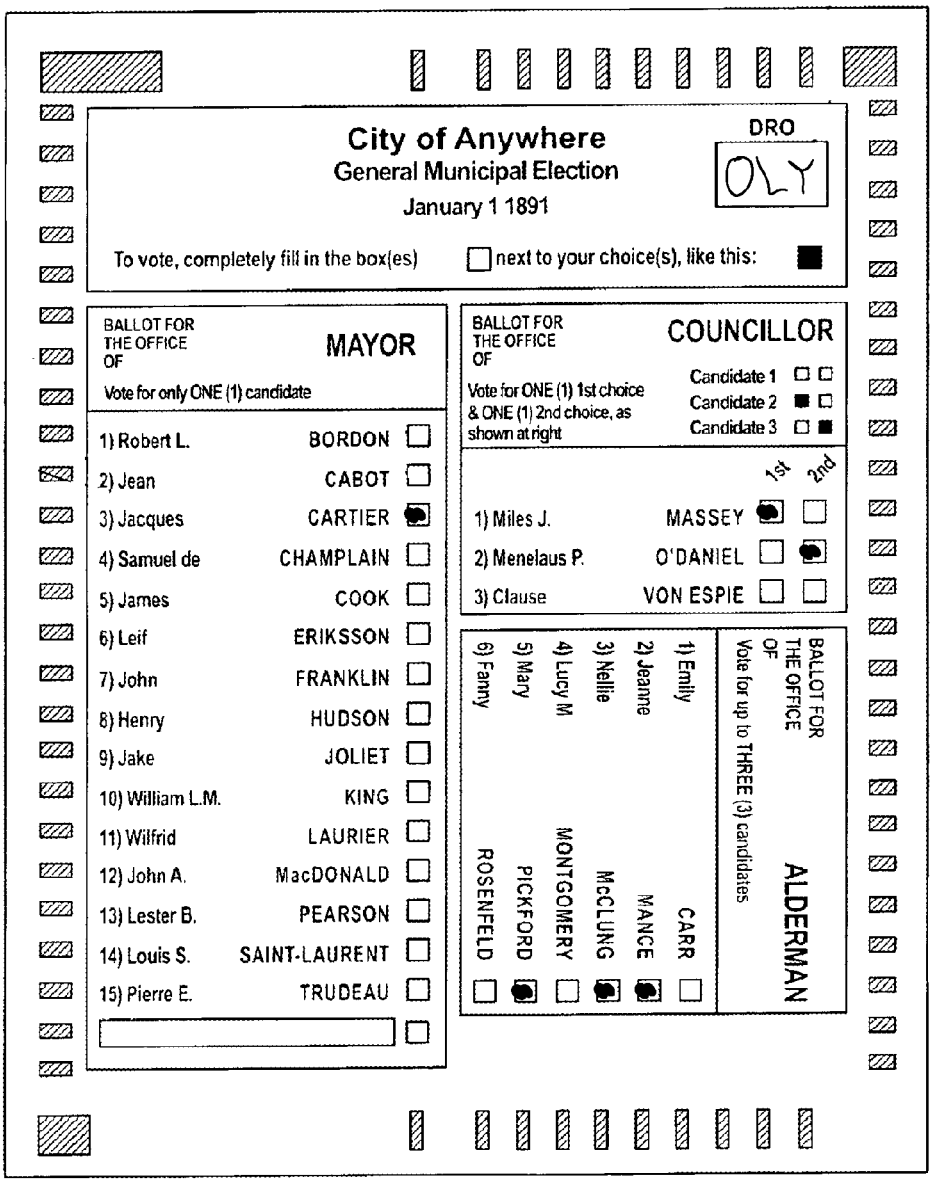
FIG. 3 is an image of a voter-marked paper ballot according to various embodiments.

FIG. 3 illustrates an example of a ballot 300 that has been properly completed by a voter. After the voter has marked the ballot 300, the voter provides the ballot to be tabulated. In some situations, the voter may drop the completed ballot (e.g., ballot 300) into a ballot box that election officials then take for processing and tabulation. In some embodiments, the election officials may direct the voter to place the ballot into an optical scan ballot system, such as optical scan ballot system 105 illustrated of FIG. 1, that scans the ballot and performs processing to determine the votes on the ballot. The voter, while still present a the optical scan ballot system, may confirm that the system properly read the votes on the ballot and/or clarify votes on the ballot, as will be described in more detail below.

Figure 4:
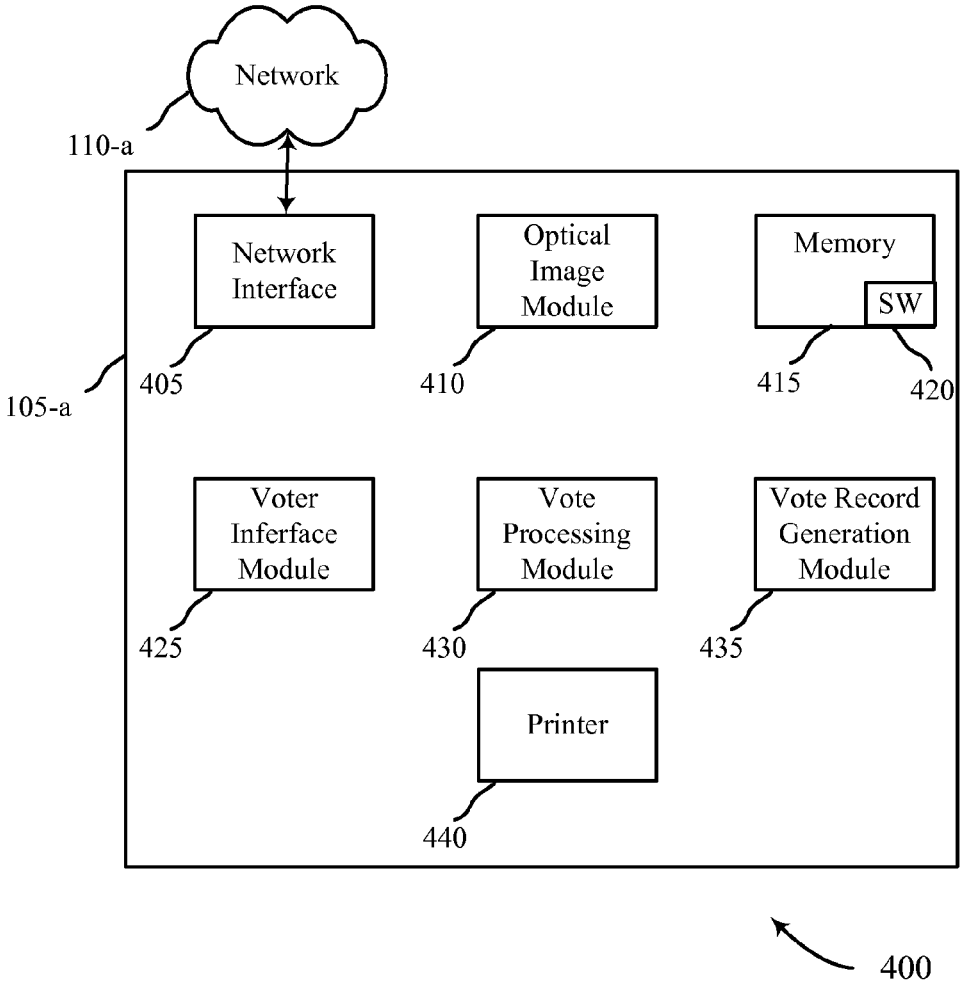
FIG. 4 is an illustration of an optical scan ballot system according to various embodiments.

FIG. 4 is an illustration of ballot receiving system 400 according to an embodiment. In this embodiment, the ballot receiving system 400 includes an optical scan ballot system 105-*a* that a includes a network interface 405 coupled with network 110-*a*. Network 110-*a* may be a public network, such as the Internet or Public Switched Telephone Network (PSTN), or may be a private network. The network interface 405 may provide encrypted communications in order to enhance security of the election results. The network interface 405 may include, for example, commonly used network interface hardware to allow connection with and communication over network 110-*a*. Such network interface hardware may include wired or wireless network interface cards and components, as are well understood in the art.

The optical scan ballot system 105-*a* also includes an optical image module 410, a memory 415 that includes software 420, a voter interface module 425, a vote processing module 430, and a vote record generation module 435. Each of the modules may be implemented using software or hardware, and each may be a means for performing one or more functions as described herein. Components 405-435 may be interconnected through well known mechanisms if needed, such as through one or more data busses, for example. In various embodiments, such as illustrated in FIG. 4, the optical scan ballot system 105-*a* may also include a printer 440, that may be used to print information on the voter-marked paper ballot.

The optical image module 410 may include, or be connected to, an optical imager such as a scanner that obtains an optical image of a voter-marked paper ballot. In some embodiments a voter feeds a ballot into a paper feed that is connected to the optical image module 410. Voter interface module 425 may include a display and input device, with instructions to the voter provided through the display. Vote processing module 430 may analyze the optical image and determine votes that are recorded on the ballot. Such analysis may be a pixel-based analysis of voter selection areas on the ballot that are marked by the voter.

As mentioned above, in some cases various voter selection areas may not be properly marked or properly read by the vote processing module 430. In the event that the vote processing module 430 determines that an error may be present on the ballot, or that one or more votes may not have been properly read, the voter may be prompted through voter interface 425 to provide clarification or correction of the vote(s). The determination that an error may be present may be made by the vote processing module 430 when one or more votes recorded on the ballot satisfy a criteria for voter clarification. Such criteria for voter clarification may be established by election officials prior to an election. In some embodiments, the voter may provide such clarification and/or correction, and the changes may be electronically recorded without the voter having to re-mark the ballot or receive a replacement ballot. Vote record generation module 435 may generate a cast vote record that includes votes determined by the vote processing module and/or modifications/clarifications provided by the voter. As mentioned above, in some cases a voter may select a write-in candidate. In such cases, the presence of a write-in vote may satisfy the criteria for voter clarification. The vote processing module 430 may determine that a write-in vote may be present, and prompt the voter, through voter interface module 425, to confirm the write-in vote and in some cases select the write-in candidate from a list of qualified write-in candidates or otherwise confirm the write-in vote by providing a correct spelling of the candidate's name. In some embodiments, the voter is prompted to confirm that their votes are accurately recorded, and given the opportunity to modify one or more votes. Following the confirmation or modification, the vote record generation module 435 may generate a cast vote record for the ballot. In some embodiments, the vote record generation module 435 may include a printer that prints recorded votes and/or any vote corrections or confirmations on the paper ballot. In such embodiments, a second image of the ballot and printed confirmations and/or corrections may be re-imaged by the optical image module 410. In other embodiments, the vote record generation module 435 may generate an optical image of the vote record, referred to as an audit mark, that may be appended to the optical image of the ballot.

Memory 415 may include random access memory (RAM) and read-only memory (ROM), and store computer-readable, computer-executable software code 420 containing instructions that are configured to, when executed (or when compiled and executed), cause the various modules 410-435 to perform various functions described herein (e.g., obtain ballot optical images, receive vote modification/clarification information, generate cast vote records, append an optical image of the audit mark information to the ballot optical image, etc.). The components of the optical scan ballot system 105-*a* may, individually or collectively, be implemented with one or more Application Specific Integrated Circuits (ASICs) adapted to perform some or all of the applicable functions in hardware. Each of the noted modules may be a means for performing one or more functions related to operation of the optical scan ballot system 105-*a*.

Figure 5:
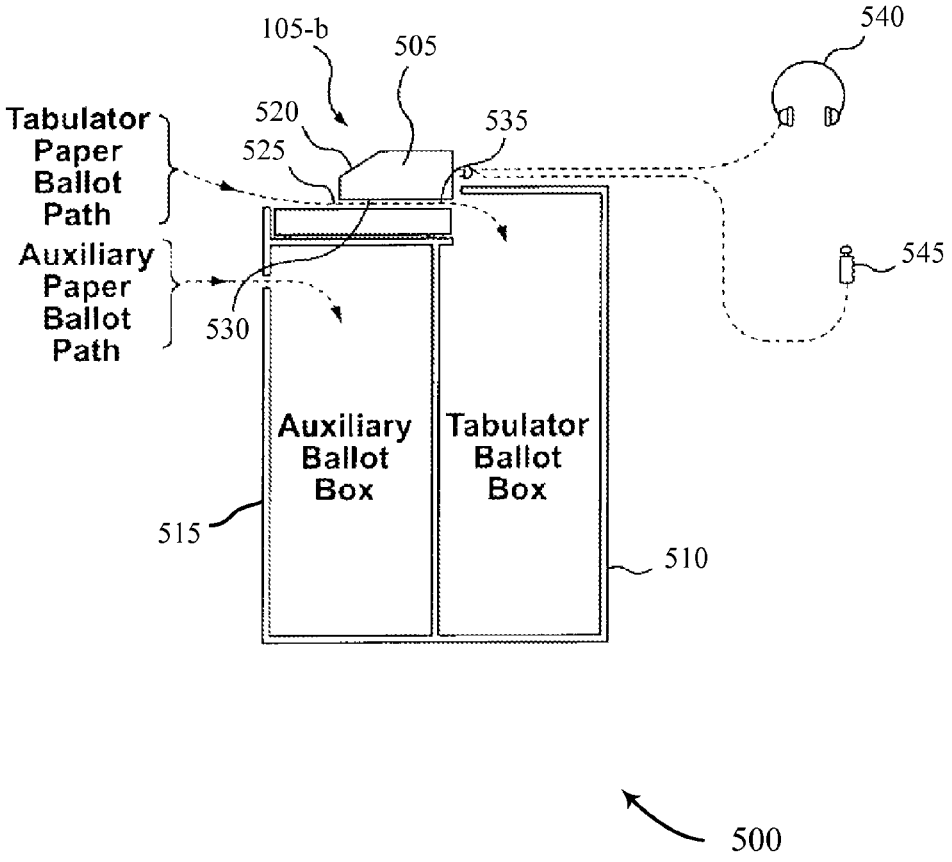
FIG. 5 is an illustration of an optical scan ballot system and ballot box according to various embodiments.

With reference now to FIG. 5, an example of another optical scan ballot system 105-*b* is described. The optical scan ballot system 105-*b* of this embodiment includes a hybrid paper/electronic vote tabulator 505. The hybrid paper/electronic vote tabulator 505, also referred to as a tabulation unit, is coupled with tabulator ballot box 510. An auxiliary ballot box 515 is also illustrated in this embodiment, and may receive ballots that are not provided to the optical scan ballot system 105-*b*. As voters come into the polling location, they may be processed by an election official who determines voter eligibility (based on local election rules), and also determines the proper ballot for the voter. The voter may then mark the ballot and take the marked paper ballot to the tabulation unit 505. In some embodiments, the tabulation unit 505 includes a display 520 that instructs the voter to feed the ballot into the tabulation unit 505 through path 525. The ballot may then be fed through the tabulator unit 505 and an image of the ballot created using a digital scanning device 530. According to various embodiments, the scanning device 530 takes a high resolution optical scan of the ballot and moves the ballot into the tabulator ballot box 510 through opening 535. In one particular aspect of the invention, the tabulation unit 505 takes the resulting high resolution scanned image of the entire ballot, and saves a copy of this image to a memory linked to the optical scan ballot system 105-*b*. The embodiment of FIG. 5 also includes earphones 540, and a pendant manual trigger 545, for use by voters that require such devices.

The tabulation unit 505 of this embodiment includes a processing module that executes software code to analyze the optical image of the ballot to determine the votes recorded on the ballot. The tabulation unit 505, in some embodiments, may also randomly assign a filename to each scanned image to provide that the order in which the ballots were scanned remains private. The tabulation unit 505 may also send a copy of the images to the central server computer system 115 of FIG. 1 for image recognition. In embodiments where tabulation unit 505 performs image processing, a ballot processing application runs an image recognition routine that is applied to the digital image and enables the tabulation unit 505 to selectively recognize specific areas of each image and may analyze such specific areas as described in more detail below to define a series of processing results associated with the particular ballot.

For example, the tabulation unit 505 may analyze the various markings on the ballot to ensure it is a valid ballot, perform a pixel count check to verify that the election official area was initialed by the election official, and perform a pixel count of each voter selection area on the ballot. In addition, as further examples of such processing results, depending on the pixel count of each marking box, the mark may be classified as a 'vote', a 'non-vote.' or an 'ambiguous mark.' These classifications may be based, for example, on the total pixel counts of the marking areas (e.g., areas 205, 210, and 215 in the example of FIG. 2) of the ballot, and/or a pattern of pixels in the marking areas. The determination of a vote, non-vote, or ambiguous mark may be made according to pixel levels defined by election officials at a given time prior to the election. In some embodiments, analysis of the optical may include determining that one or more voter selection areas have been selected when markings in the one or more voter selection areas meet a predefined first criteria for determining a specific voter selection area has been selected. The analysis may also include determining one or more votes recorded on the voter-marked paper ballot satisfy a criteria for voter clarification when markings in one or more voter selection areas meet a predefined second criteria for determining that it is ambiguous whether the one or more voter selection areas has been selected.

According to some embodiments, election officials may define, in pixels, the minimum pixel count that is to be classified as a 'vote,' and thus satisfy the predefined first criteria. Election officials may also define, in pixels, the maximum pixel count (if any) that is to be defined as a definite 'non-vote,' and a range of pixels in between those values that will constitute an 'ambiguous mark.' Pixel counts that are within the range of pixels that constitute an ambiguous mark may satisfy the predefined second criteria, and generate a prompt to the voter for clarification of the one or more votes. These pixel values may be loaded on each tabulation unit 505. After calculating these pixel values for each voter selection area, the tabulation unit 505 may return the ballot to the voter with an appropriate message if any marks on the ballot satisfy the criteria for voter clarification, or feed the ballot to the tabulator ballot box. Criteria for voter clarification may be satisfied, for example, if one or more voting areas contain an ambiguous mark, if too many marking areas in one category were classified as votes resulting in an "over-vote," if no marking areas in one or more category were classified as votes (resulting in a blank ballot for one or more elections) and/or no pixel count was recorded in the election official area.

In some embodiments, the tabulation unit 505 may be programmed to allow a voter to verify the ballot in the case of over-voted or blank ballots, thus preserving the voter's right to cast an over-voted or blank ballot. In other embodiments, the optical scan ballot system 105-*b* may prompt the voter to correct or clarify one or more votes when an ambiguous mark or over-vote is detected, allowing the voter to correct the ballot electronically. The correction(s) may be recoded in a cast vote record generated by the tabulation unit 505. Furthermore, in the event that the ballot includes one or more write-in candidates, the tabulation unit 505 may prompt the voter to confirm the write-in candidate and electronically select the write-in candidate name. In some embodiments, once the determination of the total votes for a ballot has been made, the tabulation unit 505 appends an audit mark as a footer to the saved ballot image that contains processing results for that specific ballot. In some embodiments, the tabulation unit 505 also includes a printer that may print processing results and any received voter clarifications, and/or corrections on the paper ballot prior to the ballot being moved to the tabulator ballot box 510. Such a ballot may then be re-imaged to provide an optical image of the ballot with printed clarifications and/or corrections.

Figure 6:
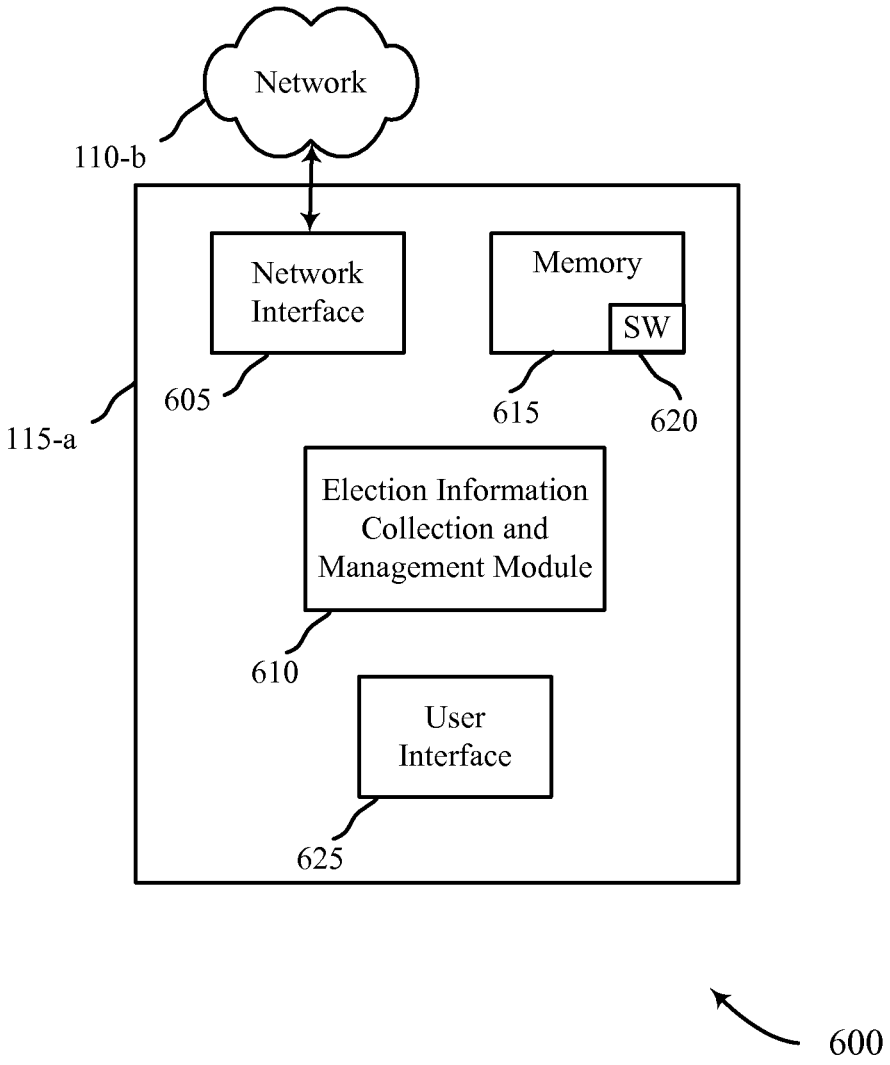
FIG. 6 is a block diagram of a central server computer system according to various embodiments.

With reference now to FIG. 6, a system 600 is described that includes central server computer system 115-*a* connected with network 110-*b*. In this embodiment, the central server computer system 115-*a* includes a network interface 605, an election information collection and management module 610, memory 615 that includes software 620 stored therein, and a user interface 625. The central server computer system 115-*a* may communicate with optical scan ballot system(s) such as system 105 of FIGS. 1, and 4-5, through the network 110-*b* in order to receive and send information to such systems. The network interface 605 may include, for example, commonly used network interface hardware to allow connection with and communication over network 110-*b*. Such network interface hardware may include wired or wireless network interface cards and components, as are well understood in the art. Each of the modules may be implemented using software or hardware, and each may be a means for performing one or more functions as described herein. Components 605-625 may be interconnected through well known mechanisms if needed, such as through one or more data busses, for example.

The election information collection and management module 610 may receive optical image data from optical scan ballot systems and store the data in memory 615. Memory 615 may include a database that is located locally and/or remotely from the central server computer system 115-*a*. Furthermore, central server computer system 115-*a* itself may include a single computer, or may include multiple computers which may be located remotely from one another. In any event, the election information collection and management module 610 may receive optical image data and use this data to determine cumulative vote counts for one or more elections, and to perform election management tasks such as, for example, assigning ballots identified as having errors for adjudication, and assigning ballots to be audited according auditing procedures for the jurisdiction to verify the optical scan ballot systems appear to be properly tabulating votes. In one embodiment, the election information collection and management module 610 receives optical image data for each scanned ballot, along with audit mark information for each ballot, and maintains appropriate vote counts based on the data. The election information collection and management module 610 may then store the optical image data, including the ballot optical image and the audit marks, in memory 615 for future retrieval as needed.

The user interface 625 may include a monitor to display images to the election management officials, as well as a keyboard, mouse, or other data input device as are well known. An election official accessing the user interface 625 may review optical images including one or more of audit mark information and ballot images, as necessary. The election official may also use the user interface 625 to monitor the status of various optical scan systems that may be managed through the system 600. The user interface 625 may also provide statistical information for use by election officials, as well as a number of other types of information that may be useful for efficient election management.

Memory 615 may include random access memory (RAM) and read-only memory (ROM), and store computer-readable, computer-executable software code 620 containing instructions that are configured to, when executed (or when compiled and executed), cause the election information collection and management module 610 to perform various functions described herein. The components of the central server computer system 115-*a* may, individually or collectively, be implemented with one or more Application Specific Integrated Circuits (ASICs) adapted to perform some or all of the applicable functions in hardware. Each of the noted modules may be a means for performing one or more functions related to operation of the central server computer system 115-*a*.

Figure 7:
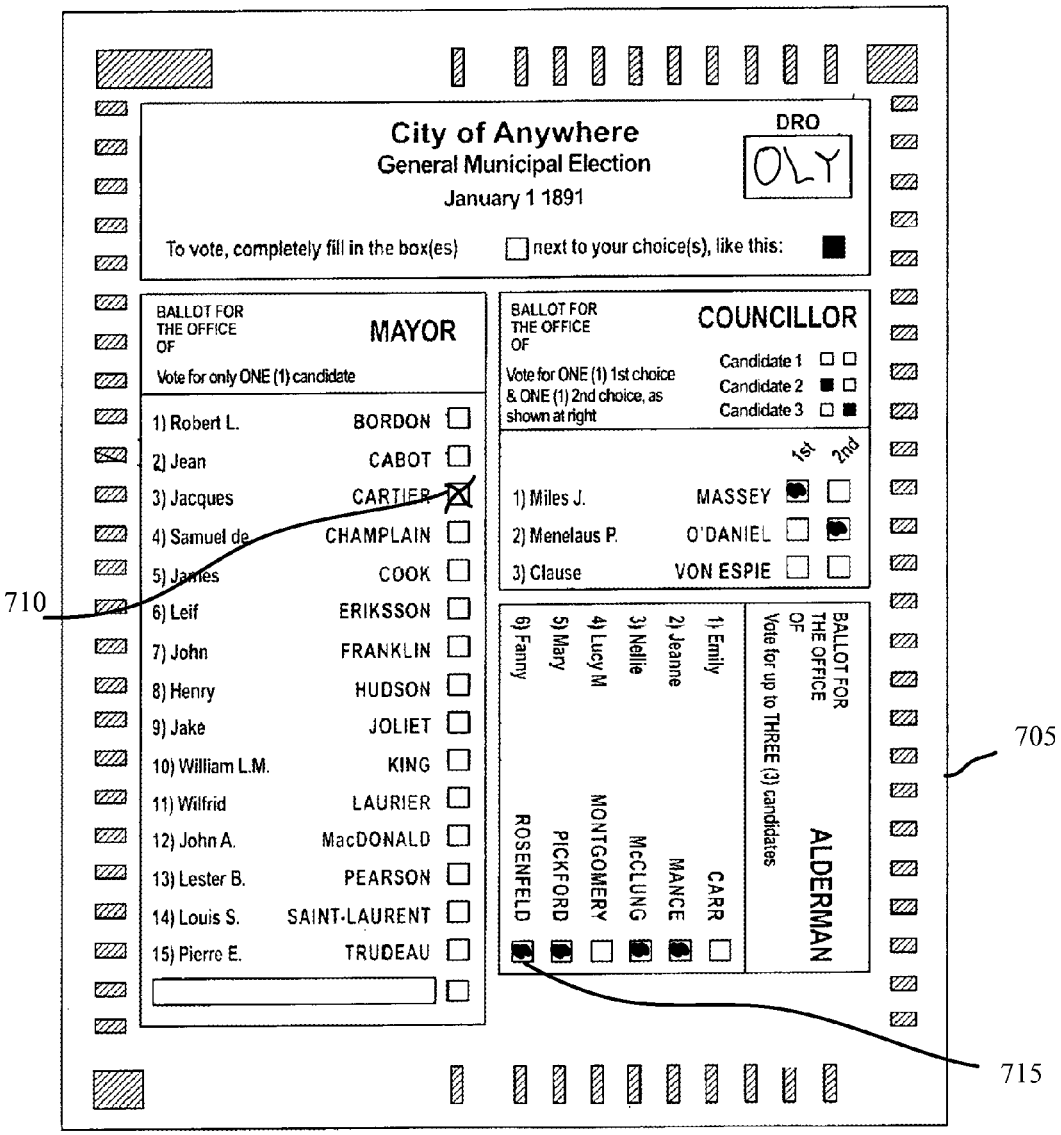
FIG. 7 is an image of an incorrectly marked paper ballot according to various embodiments.

FIG. 7 illustrates an image 700 that includes an optical image of a voter-marked paper ballot 705, that includes improperly marked vote selections. In this example, the ballot 705 includes a target area 710 in the vote for MAYOR that is not completely filled-in, and thus may not be properly recorded as a vote by an optical scan ballot system, such as system 105 of FIGS. 1, and 4-5. Additionally, ballot 705 includes an over-vote 715 for the race of ALDERMAN, where the voter has incorrectly marked four candidates where the instructions state that up to three candidates may be voted for. As mentioned above, an optical scan ballot system may not properly read the vote 710 for MAYOR. In some embodiments, an optical scan ballot system may determine that the mark for the MAYOR vote are below a threshold for a vote, and thus indicate that the ballot 705 does not include a vote for MAYOR. In other embodiments, the optical scan ballot system may identify the mark in the MAYOR vote 710 as a marginal or ambiguous mark, as described above, and thus satisfies a criteria for voter clarification. In either event, the optical scan ballot system may prompt the voter based on the determination. Similarly, an optical scan ballot system may properly identify all four votes for the ALDERMAN selection 715, the over-vote satisfying a criteria for voter clarification, and prompt the voter to change one or more of the selections based on the determination.

Figure 8:
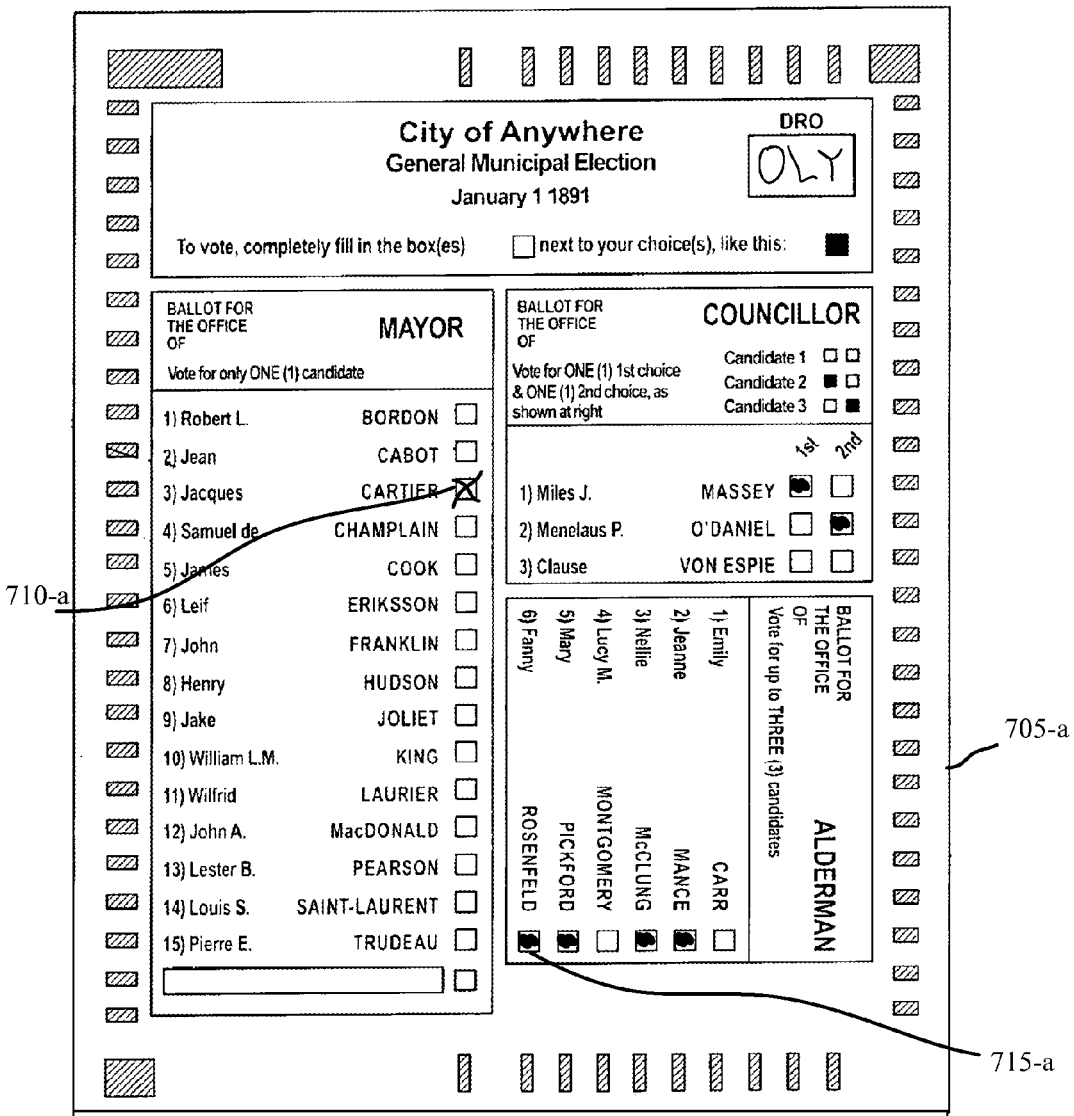
FIG. 8 is an image of an incorrectly marked paper ballot with an appended vote mark indicating electronic voter corrections according to various embodiments.

FIG. 8 illustrates an image 800 of ballot 705-*a* along with an audit mark 805 that may be appended to an optical image 705-*a*. As mentioned above, an optical scan ballot system may prompt a voter to clarify or correct the votes 710-*a* and 715-*a* that were determined to satisfy the criteria for voter clarification. In response thereto, the voter may confirm that the vote for MAYOR is to be for selection 3) Jacques CARTIER, and that the Alderman vote for Fanny ROSENFELD 715-*a* was an error and not a vote. In one embodiment, the audit mark may identify the errors on the ballot and also include an indication that the voter confirmed the different votes, as illustrated in audit mark 805. The cast vote record for the ballot 705-*a* may also include similar information. Thus, a record of the voter intent is recorded while the voter is still present at the polling place.

The audit mark 805, according to some embodiments, is included as an image in the same file that contains the optical image 705-*a* of the voter-marked paper ballot. In such a manner, if a user displays the optical image of the voter-marked paper ballot, the audit mark will also be displayed allowing the user to view the ballot and voter markings as well as information on how the tabulation unit registered the votes for the ballot and any confirmations received from the voter. Such a system allows for auditing of election results in an efficient manner. It will be understood that appending an optical audit mark image to the ballot optical image is just one manner in which the votes recorded for a ballot may be associated with the ballot, and may be used instead or, or in addition to a cast vote record for the ballot. In some embodiments, the information from the tabulation unit may be stored in a separate database and associated with a particular ballot, or may be stored in the ballot optical image file as extra data or metadata that may or may not be displayed along with an image of the ballot. The embodiment of FIG. 8 illustrates the audit mark 805 at a footer of the optical ballot image 705-*a*, although it will be readily understood that an audit mark image 805 may be located at different locations relative to the ballot image 705-*a*. The audit mark 805 may also be referred to as a "fingerprint" or a "vote stamp" that is attached or otherwise associated with each image.

In embodiments where the audit mark 805 is appended as an image to the voter-marked paper ballot optical image 705-*a*, the image may be saved in a format that is widely viewable by a variety of different image viewers. For example, the optical image may be stores as a .jpg file, a .tiff file, or a .pdf file, to name just a few examples. Various different types of viewers may be used to display such files, allowing the review of election results that does not require specialized software. Furthermore, the inclusion of an audit mark with the ballot optical image allows for review of how an optical scanning system read the particular ballot through simply viewing the optical image file.

Figure 9:
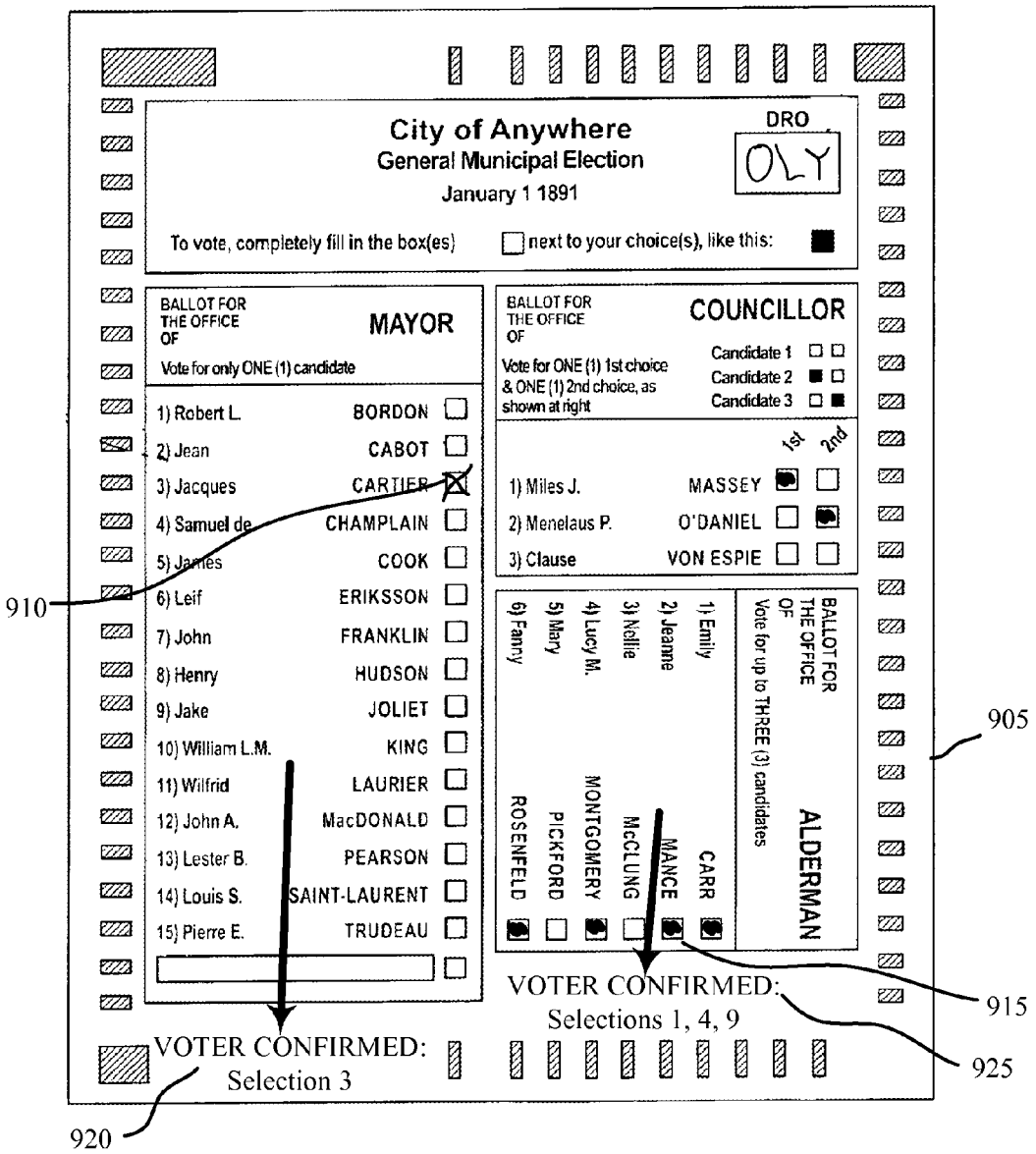
FIG. 9 is an image of an incorrectly marked paper ballot with electronic voter corrections printed on the ballot according to various embodiments.

In some embodiments, an audit mark, such as audit mark 805 of FIG. 8, may be printed on the paper ballot by an optical scan ballot system. Such an audit mark may be printed in an open space on the paper ballot that is intended for such a purpose. The ballot with printed audit mark may, in some embodiments, be re-scanned by the optical scan ballot system. In other embodiments, no markings are printed on the paper ballot, with modifications to the cast vote record and/or audit mark associated with the ballot relied on for recording the processing results of the optical scan ballot system and any voter confirmation. In still other embodiments, an optical scan ballot system may print an indication on paper ballots only when voter modification or clarification for a particular vote is received, and such a printed ballot may be re-scanned to generate an optical image of the paper ballot with printed voter modification and/or clarification. FIG. 9 illustrates an image 900 of ballot 905. Ballot 905 includes improper markings 910 for the MAYOR candidate, and 915 for an extra ALDERMAN candidate. In this embodiment, the voter may be prompted to confirm or correct the votes, with confirmation received from the voter. Such confirmation may be recorded in the cast vote record and/or audit mark for the ballot 905, and in the embodiment of FIG. 9 the optical scan ballot system also prints an indication directly on the paper ballot indicating the voter confirmations. In this example, an indication 920 is printed on the ballot that the voter confirmed selection 3 for the MAYOR candidate, and an indication 925 that the voter confirmed selections 1, 4, and 9 for the ALDERMAN candidates.

Figure 10:
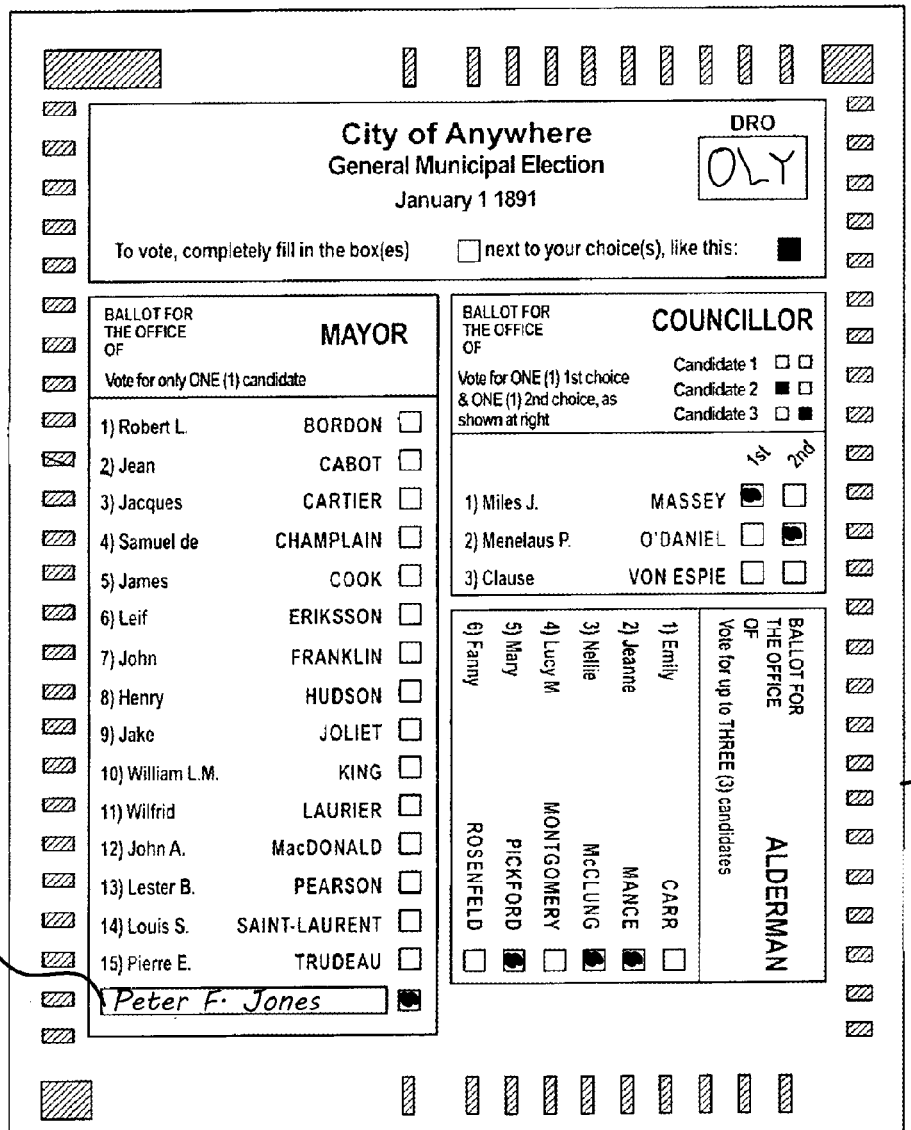
FIG. 10 is an image of a voter-marked paper ballot with a write-in vote and appended vote mark indicating electronic voter write-in confirmation according to various embodiments.

As mentioned above, in some instances a voter may vote for a write-in candidate for a particular election. FIG. 10 illustrates an image 1000 of a ballot 1005 that includes a write-in vote 1010. In this example, the voter properly marked the target area for a write-in vote, and wrote candidate name Peter F. Jones. The ballot 1005 of this example is otherwise correctly completed, although it will be readily recognized that any incorrectly completed votes may be confirmed as described herein. In this embodiment, an optical scan ballot system may identify that the ballot 1005 includes write-in vote 1010, the presence of a write-in vote satisfying a criteria for voter clarification. The system may prompt the voter to confirm that they would like to vote for the write-in candidate, and also confirm the name of the write-in candidate. In such a manner, write-in votes may be confirmed and tabulated without the need for an election official to manually read the write-in vote, which may be difficult to read due to poor penmanship, for example. Furthermore, in some jurisdictions, write-in candidates are required to be qualified with election officials prior to the election. In such jurisdictions, the optical scan ballot system may be provided with a list of qualified write-in candidates, and the voter may be notified if their write-in candidate is not included in the list, in which case the voter may decide to vote for a different candidate. The optical scan ballot system may include write-in information in the cast vote record for the ballot and/or include the information in an audit mark for the ballot. In the example of FIG. 10, an audit mark 1015 is appended to the ballot optical image 1005 that indicates that voter confirmed the write-in vote and the candidate that was written in.

Figure 11:
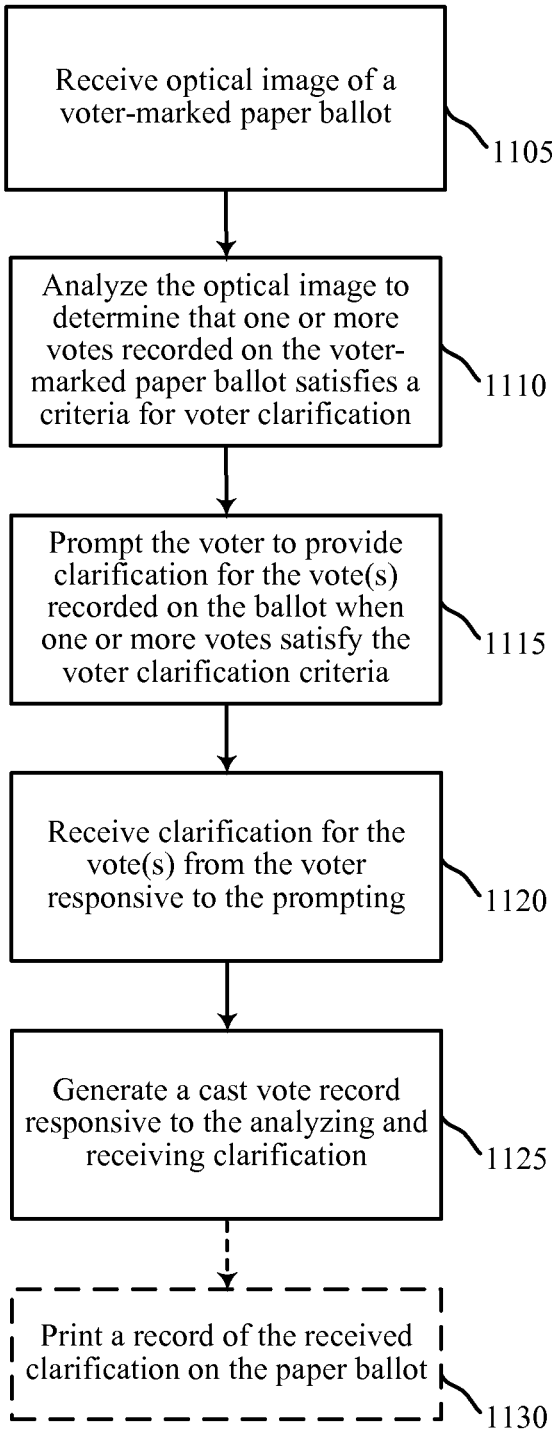
FIG. 11 is a flow chart illustrating operational steps of electronic ballot correction according to various embodiments.

With reference now to FIG. 11, a method 1100 for electronically correcting voter-marked paper ballots is described. The method 1100 may, for example, be performed by an optical scan ballot system, or a central server computer system, of FIGS. 1, and 4-6, or using any combination of the devices described for these figures. Initially, at block 1105, optical image data comprising an optical image of a voter-marked paper ballot is received. As discussed above, optical image data may be received from an optical scan ballot system that scans a voter-marked paper ballot, for example. The optical image is analyzed to determine that one or more votes recorded on the voter-marked paper ballot satisfies a criteria for voter clarification, according to block 1110. Such votes may be identified, for example, as votes that have ambiguous marks on the voter-marked paper ballot, elections or races in which no vote is entered (an 'undervote'), elections or races where too many candidates have been voted for (an 'overvote'), and/or the presence of a write-in candidate. Votes requiring clarification may be identified, in some examples, locally by an optical scan ballot system or locally connected computer, or remotely by a central server computer system, with the optical image data and identified votes for clarification communicated between the central server computer system and the optical scan ballot system over a network.

With continuing reference to FIG. 11, the voter is prompted to provide clarification for the vote(s) recorded on the ballot when one or more votes satisfy the voter clarification criteria, as indicated at block 1115. The voter may be prompted, for example, through a user interface located at an optical scan ballot system. In such embodiments, a voter may feed their ballot into a ballot feed mechanism at the optical scan ballot system, and be prompted to provide clarification for one or more votes before they leave the polling location. At block 1120, clarification for the vote(s) is received from the voter responsive to the prompting. Such clarification may include a confirmation of one or more votes, or the correction of one or more votes. For example, if a ballot includes an over-vote, the voter may select the candidate that they would like to vote for, with such a correction received at the system. A cast vote record is generated responsive to the analyzing and receiving clarification, as indicated at block 1125. The cast vote record may include vote information, as well as any clarification information, such as vote confirmations or corrections, that were received from the voter. The cast vote record, according to some embodiments, is used in vote tallying to determine election outcomes. Optionally, as indicated at block 1130, a record of the received clarification may be printed on the paper ballot. The information may be printed on the ballot separately, or as a part of an audit mark that is printed on the ballot, similarly as discussed above. Additionally, in embodiments that include a record of the received clarification printed on the paper ballot, the ballot may be re-imaged to generate second optical image data of the ballot including the printed clarification.

In some embodiments, an optical image of the voter-marked paper ballot and votes recorded for the ballot may be generated. The optical image data may be provided in a format that is widely known and used, such as, for example, .jpg, .tiff, .bmp, or .pdf format. Having optical image data in such a format allows the ballot optical image and the adjudication information optical image to be viewed on many different platforms and using any of a number of widely available viewers, rather than requiring a proprietary viewer to view both the ballot and adjudication information.

Figure 12:
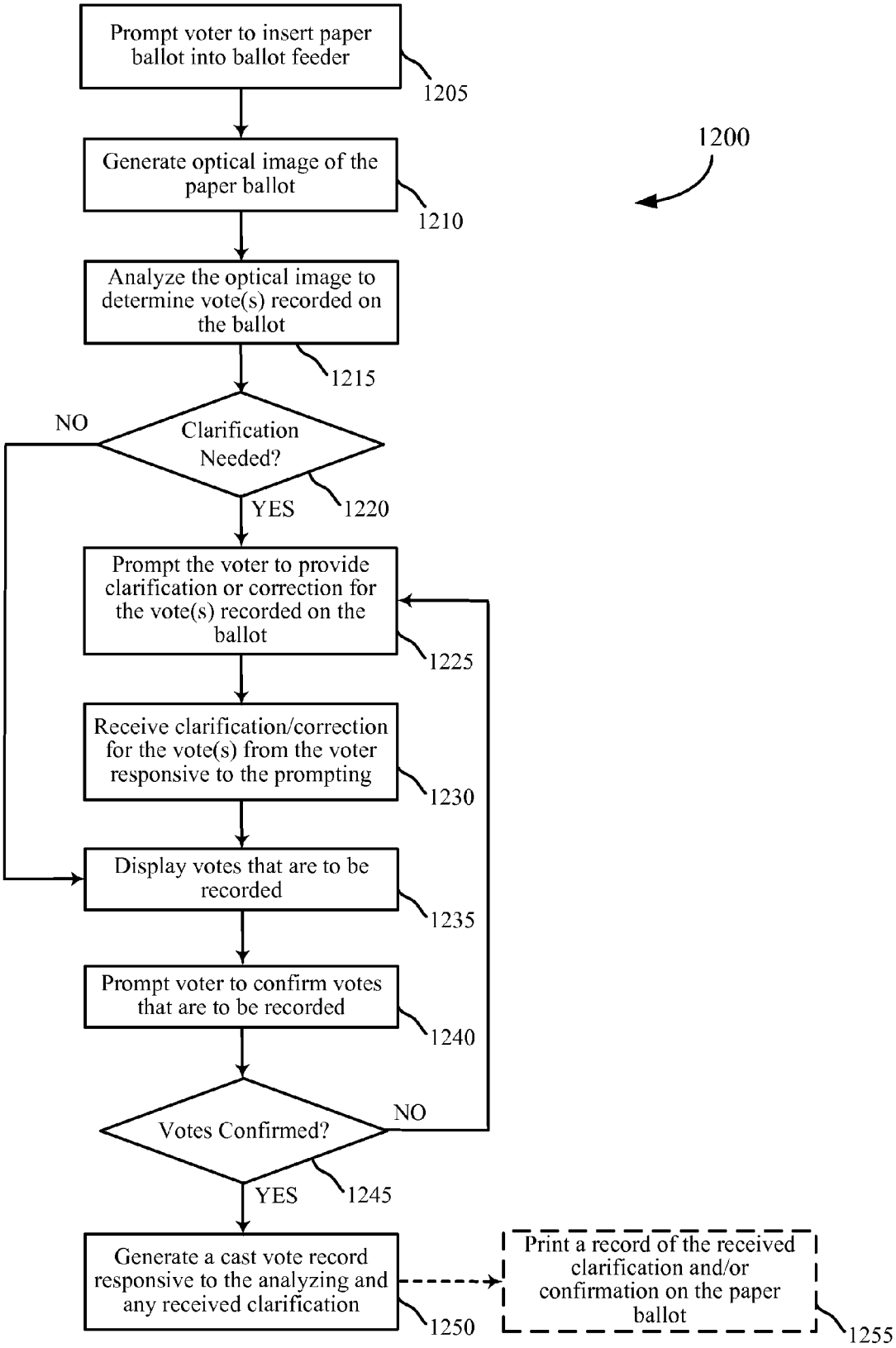
FIG. 12 is another flow chart illustrating operational steps of electronic ballot correction according to various embodiments.

With reference now to FIG. 12, another method 1200 for electronic correction of voter-marked paper ballots is described. The method 1200 may, for example, be performed by a central server computer system or optical scan ballot system of FIGS. 1, and 4-6, or using any combination of the devices described for these figures. Initially, at block 1205, a voter is prompted to insert a paper ballot into a ballot feeder. The ballot feeder may be included as part of an optical scan ballot system and be connected to a ballot box that will ultimately receive the paper ballot. As discussed above, such an optical scan ballot system may prompt the voter to insert the ballot into the feeder, and provide instructions to the voter for completing the voting process. At block 1210, an optical image of the paper ballot is generated. The optical image may be generated from an optical scanner or other imaging device that is connected with the optical scan ballot system for example. The optical image is analyzed, at block 1215, to determine votes that are recorded on the ballot. Such determination may be based on image analysis of the optical image, such as described above, for example.

At block 1220 it is determined if clarification of any votes is needed. If clarification is needed, the voter is prompted, at block 1225, to provide clarification or correction for the identified vote(s) recorded on the ballot. At block 1230, clarification and/or correction of identified vote(s) are received. Votes that are to be recorded are displayed to the voter, according to block 1235. The voter is then prompted to confirm that votes that are to be recorded, as indicated at block 1240. At block 1245, it is determined if the votes are confirmed. If the voter does not confirm the votes, indicating that they would like to change one or more votes, the operations beginning at block 1225 are performed. If the votes are confirmed at block 1245, a cast vote record is generated responsive to the analyzing and any received clarifications and/or corrections. Optionally, at block 1255, a record of the received clarifications and/or corrections is printed on the paper ballot. Additionally, in embodiments that include a record of the received clarifications and/or corrections printed on the paper ballot, the ballot may be re-imaged to generate second optical image data of the ballot including the printed information. If, at block 1220, it is determined that clarification is not needed responsive to analyzing of the optical image, operations of block 1235 are performed.

Figure 13:
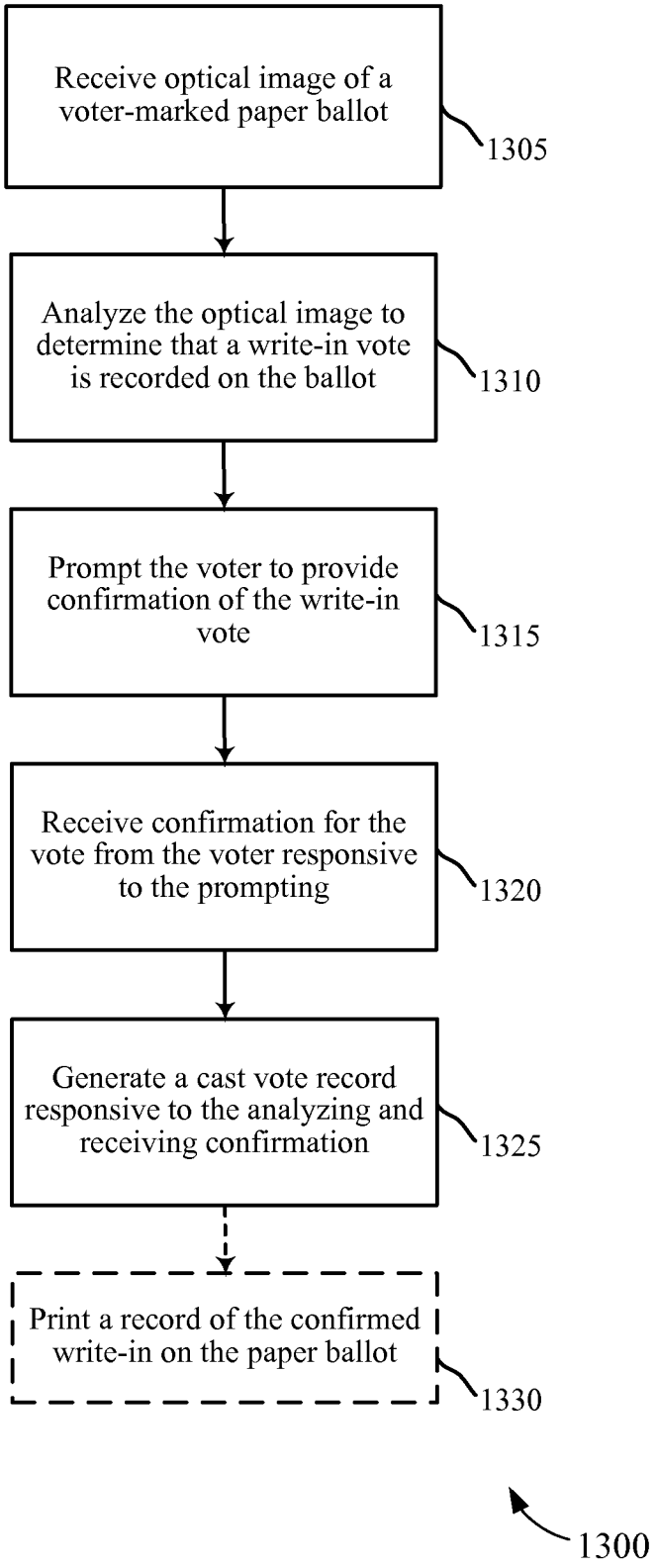
FIG. 13 is a flow chart illustrating operational steps of voter write-in confirmation according to various embodiments.

In some embodiments, as mentioned above, one or more ballots may include one or more write-in votes. For example, a voter may choose to vote for a candidate that is not listed on the ballot. With reference now to FIG. 13, a method 1300 for electronic confirmation of write-in candidates is described. The method 1300 may, for example, be performed by an adjudication system, a central server computer system, or optical scan ballot system of FIGS. 1 and 4-6, or using any combination of the devices described for these figures.

Initially, at block 1305, optical image data comprising an optical image of a voter-marked paper ballot is received. As discussed above, optical image data may be received from an optical scan ballot system that scans a voter-marked paper ballot, for example. The optical image is analyzed to determine vote(s) recorded on the ballot, and to determine whether a write-in vote is recorded on the ballot, according to block 1310. Such votes may be identified, for example, as votes that have marks in a write-in vote target area and/or if analysis of the optical image indicated that writing is present in the write-in vote area. The presence of write-in votes may be identified, in some examples, by a central server computer system, with the optical image data and identified write-in votes for confirmation provided to an optical scan ballot system over a network.

With continuing reference to FIG. 13, the voter is prompted to provide confirmation of the write-in vote recorded on the ballot, as indicated at block 1315. The voter may be prompted, for example, through a user interface located at an optical scan ballot system. In such embodiments, a voter may be prompted to confirm that they wish to vote for a write-in candidate, and to enter the name of the write-in candidate. In some embodiments, the writing in the write-in area may be analyzed to determine characters and provide the identified candidate name to the voter for confirmation. In other embodiments, the system may reference a list of registered write-in candidates, and prompt the voter to select a candidate from the list or select a different candidate from the ballot. At block 1320, confirmation of the write-in vote is received from the voter responsive to the prompting. A cast vote record is generated responsive to the analyzing and receiving confirmation, as indicated at block 1325. The cast vote record may include vote information, as well as any clarification information, such as vote confirmations or corrections, that were received from the voter. The cast vote record, according to some embodiments, is used in vote tallying to determine election outcomes. Optionally, as indicated at block 1330, a record of the received confirmation may be printed on the paper ballot. The information may be printed on the ballot separately, or as a part of an audit mark that is printed on the ballot, similarly as discussed above. Additionally, in embodiments that include a record of the received confirmation printed on the paper ballot, the ballot may be re-imaged to generate second optical image data of the ballot including the printed confirmation.

In some embodiments, an optical image of the voter-marked paper ballot and votes recorded for the ballot, including write-in confirmation, may be generated. The optical image data may be provided in a format that is widely known and used, such as, for example, .jpg, .tiff, .bmp, or .pdf format. Having optical image data in such a format allows the ballot optical image and the adjudication information optical image to be viewed on many different platforms and using any of a number of widely available viewers, rather than requiring a proprietary viewer to view both the ballot and adjudication information.

Figure 14:
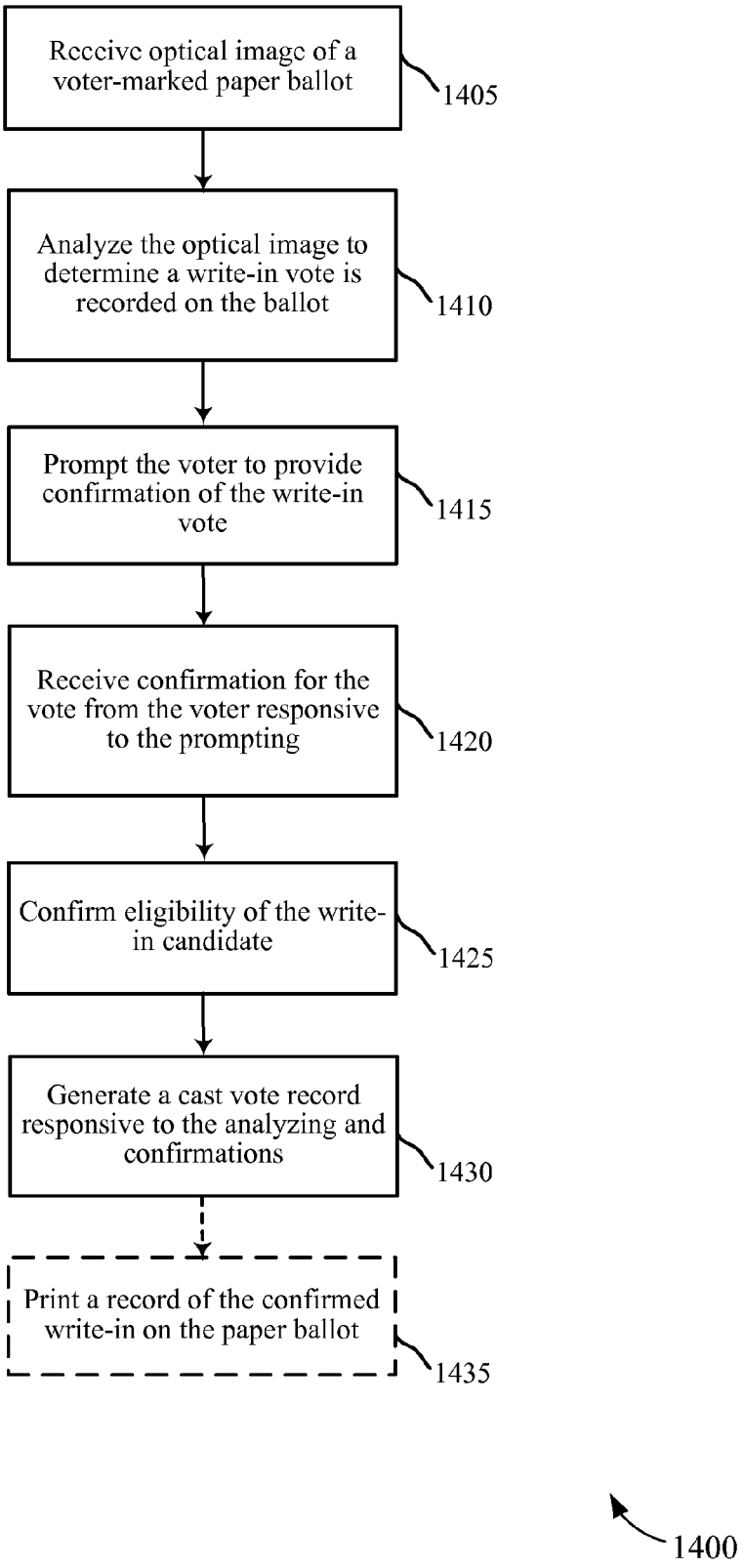
FIG. 14 is another flow chart illustrating operational steps of voter write-in confirmation according to various embodiments.

With reference now to FIG. 14, another method 1400 for electronic confirmation of write-in candidates is described. The method 1400 may, for example, be performed by an adjudication system, a central server computer system, or optical scan ballot system of FIGS. 1 and 4-6, or using any combination of the devices described for these figures.

Initially, at block 1405, optical image data comprising an optical image of a voter-marked paper ballot is received. As discussed above, optical image data may be received from an optical scan ballot system that scans a voter-marked paper ballot, for example. The optical image is analyzed to determine vote(s) recorded on the ballot, and to determine whether a write-in vote is recorded on the ballot, according to block 1410. Such votes may be identified, for example, as votes that have marks in a write-in vote target area and/or if analysis of the optical image indicated that writing is present in the write-in vote area. The presence of write-in votes may be identified, in some examples, by a central server computer system, with the optical image data and identified write-in votes for confirmation provided to an optical scan ballot system over a network.

With continuing reference to FIG. 14, the voter is prompted to provide confirmation of the write-in vote recorded on the ballot, as indicated at block 1415. The voter may be prompted, for example, through a user interface located at an optical scan ballot system. In such embodiments, a voter may be prompted to confirm that they wish to vote for a write-in candidate, and to enter the name of the write-in candidate. In some embodiments, the writing in the write-in area may be analyzed to determine characters and provide the identified candidate name to the voter for confirmation. At block 1420, confirmation of the write-in vote is received from the voter responsive to the prompting. At block 1425, the eligibility of the write-in candidate is verified. As mentioned above, in some jurisdictions write-in candidates are to be qualified prior to an election. In such jurisdictions, various embodiments may provide the ability to reference a list of qualified write-in candidates to confirm eligibility. If the candidate is not qualified, the voter may be prompted to select another candidate, or may simply change their vote to a no-vote.

A cast vote record is generated responsive to the analyzing and receiving confirmation, as indicated at block 1430. The cast vote record may include vote information, as well as any clarification information, such as vote confirmations or corrections, that were received from the voter. The cast vote record, according to some embodiments, is used in vote tallying to determine election outcomes. Optionally, as indicated at block 1435, a record of the received confirmation may be printed on the paper ballot. The information may be printed on the ballot separately, or as a part of an audit mark that is printed on the ballot, similarly as discussed above. In some embodiments, an optical image of the voter-marked paper ballot and votes recorded for the ballot, including write-in confirmation, may be generated, similarly as discussed above.

Figure 15:
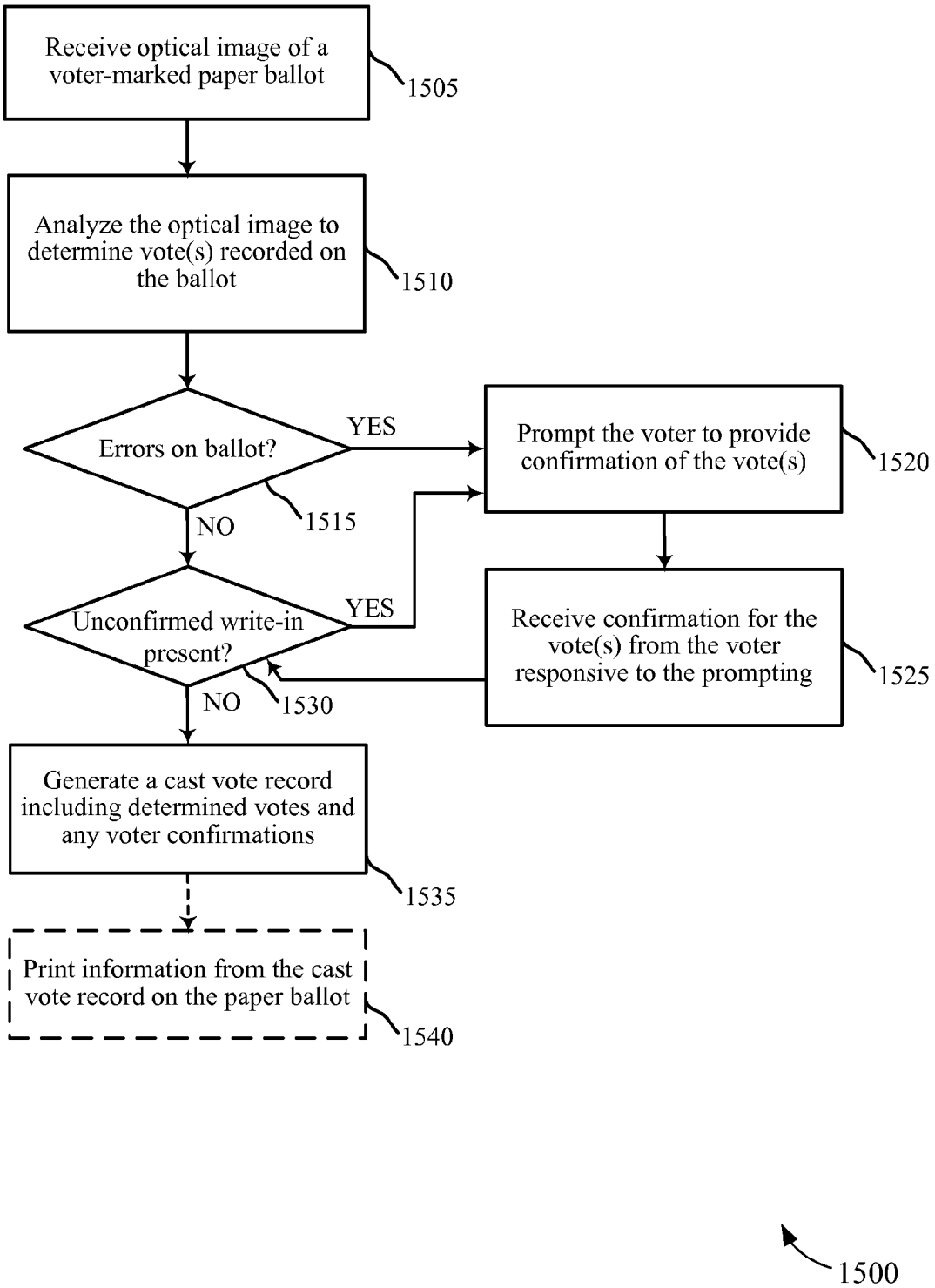
FIG. 15 is a flow chart illustrating operational steps of electronic ballot correction and voter write-in confirmation according to various embodiments.

With reference now to FIG. 15, operations for voter correction and confirmation of votes on a voter-marked paper ballot are described for another set of embodiments. The method 1500 may, for example, be performed by an adjudication system, a central server computer system, or optical scan ballot system of FIGS. 1 and 4-6, or using any combination of the devices described for these figures.

Initially, at block 1505, optical image data comprising an optical image of a voter-marked paper ballot is received. As discussed above, optical image data may be received from an optical scan ballot system that scans a voter-marked paper ballot, for example. The optical image is analyzed to determine vote(s) recorded on the ballot, according to block 1510. At block 1515, it is determined if any errors are present on the ballot. Errors may result from improperly filled in target areas, over-votes, and/or undervotes, similarly as described above. If errors are identified on the ballot, the voter is prompted to provide confirmation and/or clarification/correction of the identified votes. The voter may be prompted, for example, through an interface at an optical scan ballot system.

At block 1525, confirmation and/or clarification/correction of the identified vote(s) is received from the voter. The voter, in such an instance, may confirm or change the recorded vote, for example, through the voter interface. If, at block 1515, it is determined that no errors are identified on the ballot, it is determined, at block 1530 if any write-in votes are present on the ballot. Such votes may be identified, for example, as votes that have marks in a write-in vote target area and/or if analysis of the optical image indicated that writing is present in the write-in vote area. The presence of write-in votes may be identified, in some examples, by a central server computer system, with the optical image data and identified write-in votes for confirmation provided to an optical scan ballot system over a network. If a write-in vote is present, the operations of blocks 1520-1525 are performed.

If no errors are identified, and no write-in votes are identified, or following receipt of confirmations and/or corrections to a ballot, a cast vote record is generated, according to block 1535. The cast vote record may include vote information, as well as any correction or confirmation information, such as vote confirmations or corrections, that were received from the voter. The cast vote record, according to some embodiments, is used in vote tallying to determine election outcomes. Optionally, as indicated at block 1540, a record of the received information may be printed on the paper ballot. The information may be printed on the ballot separately, or as a part of an audit mark that is printed on the ballot, similarly as discussed above. In some embodiments, an optical image of the voter-marked paper ballot and votes recorded for the ballot, including write-in confirmation, may be generated, similarly as discussed above.

In such a manner, voter-marked paper ballots may be corrected and voter intentions confirmed electronically. In the case of corrections made to a ballot, such corrections may be made electronically through a record in a cast vote record and/or through including the information in an audit mark associated with the ballot, with the information printed on the ballot, according to carious embodiments.

It should be noted that the methods, systems and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the invention.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Moreover, as disclosed herein, the term "memory" or "memory unit" may represent one or more devices for storing data, including read-only memory (ROM), random access memory (RAM), magnetic RAM, core memory, magnetic disk storage mediums, optical storage mediums, flash memory devices or other computer-readable mediums for storing information. The term "computer-readable medium" includes, but is not limited to, portable or fixed storage devices, optical storage devices, wireless channels, a sim card, other smart cards, and various other mediums capable of storing, containing or carrying instructions or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a computer-readable medium such as a storage medium. Processors may perform the necessary tasks.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A method for modifying one or more votes on a voter-marked paper ballot, comprising:

receiving an optical image of the voter-marked paper ballot;

analyzing the optical image to determine that one or more votes recorded on the voter-marked paper ballot satisfy a criteria for voter clarification;

prompting the voter on a voter interface to provide clarification for one or more votes recorded on the voter-marked paper ballot when one or more votes satisfy the voter clarification criteria;

receiving clarification via the voter interface for one or more votes from the voter responsive to the prompting, wherein the clarification comprises at least one of corrections or modifications, of the voter-marked paper ballot; and generating a cast vote record responsive to the analyzing and receiving clarification.

2. The method of claim 1, further comprising:

printing a record of the received clarification on the voter-marked paper ballot.

3. The method of claim 2, further comprising:

receiving a second optical image of the voter-marked paper ballot and printed record of the received clarification.

4. The method of claim 2, wherein printing a record comprises:

printing information from the cast vote record and a record of the clarification received from the voter in a margin of the voter-marked paper ballot.

5. The method of claim 1, further comprising:

generating a vote mark comprising the one or more votes recorded on the voter-marked paper ballot and any clarification for one or more votes received from the voter.

6. The method of claim 5, further comprising:

appending an optical image of the vote mark to the optical image of the voter-marked paper ballot.

7. The method of claim 1, further comprising:

transmitting the cast vote record to a central server computer system.

8. The method of claim 1, further comprising:

transmitting the optical image of the voter-marked paper ballot and the cast vote record to a central server computer system.

9. The method of claim 1, wherein the analyzing to determine that one or more votes satisfy the voter clarification criteria comprises:

analyzing the optical image to determine whether a write-in vote is recorded on the voter-marked paper ballot.

10. The method of claim 9, wherein, the prompting the voter to provide clarification comprises prompting the voter to provide confirmation for the write-in vote;

the receiving clarification for one or more votes comprises receiving confirmation for the write-in vote from the voter responsive to the prompting the voter to provide confirmation for the write-in vote; and the generating the cast vote record comprises generating write-in vote confirmation information for inclusion in the cast vote record.

11. The method of claim 9, wherein the prompting the voter to provide clarification comprises:

prompting the voter to provide a write-in candidate name.

12. The method of claim 9, wherein the receiving clarification further comprises:

determining a write-in candidate included with the write-in vote; and verifying the write-in candidate is qualified with an election authority.

13. The method of claim 1, wherein the voter clarification criteria comprises a write-in vote on the voter-marked paper ballot.

14. The method of claim 1, wherein the voter-marked paper ballot comprises a plurality of voter selection areas, and the analyzing the optical image further comprises:

determining that one or more voter selection areas have been selected when markings in the one or more voter selection areas meet a predefined first criteria for determining a specific voter selection area has been selected; and determining one or more votes recorded on the voter-marked paper ballot satisfy the criteria for voter clarification when markings in one or more voter selection areas meet a predefined second criteria for determining that it is ambiguous whether the one or more voter selection areas has been selected.

15. The method of claim 14, wherein analyzing the optical image further comprises:

performing a pixel count of each voter selection area, the pixel count identifying a number of pixels in the optical image that contain a voter marking.

16. The method of claim 15, wherein the predefined first criteria comprises a minimum pixel count that is to be classified as a vote.

17. The method of claim 15, wherein the predefined second criteria comprises a range of pixel counts between a minimum pixel count that is to be classified as a non-vote and a minimum pixel count that is to be classified as a vote.

18. A system for modifying one or more votes on a voter-marked paper ballot, comprising:

an optical image module that receives a voter-marked paper ballot and generates an optical image of the voter-marked paper ballot;

a vote processing module configured to analyze the optical image to determine that one or more votes recorded on the voter-marked paper ballot satisfy a criteria for voter clarification;

a voter interface module configured to:

prompt the voter on a voter interface to provide clarification for one or more votes recorded on the voter-marked paper ballot when one or more votes satisfy the voter clarification criteria; and receive clarification via the voter interface for one or more votes from the voter responsive to the prompting, wherein the clarification comprises at least one of corrections, or modifications, of the voter-marked paper ballot; and a vote record generation module configured to generate a cast vote record responsive to the analyzing and receiving clarification.

19. The system of claim 18, further comprising:

a printer coupled with the vote record generation module and configured to print, on the voter-marked paper ballot, a record of the received clarification for one or more votes from the voter.

20. The system of claim 19, wherein the printer is further configured print an identification of the one or more votes that were determined to require clarification and a record of the clarification received from the voter in a margin of the voter-marked paper ballot.

21. The system of claim 20, wherein the optical image module further generates an optical image of the voter-marked paper ballot and printed clarification.

22. The system of claim 19, wherein the vote processing module is further configured to generate a vote mark comprising the one or more votes recorded on the voter-marked paper ballot and any clarification for one or more votes received from the voter; and wherein the printer is further configured to print the vote mark on the voter-marked paper ballot.

23. The system of claim 18, wherein one or more votes satisfy the voter clarification criteria when a write-in vote is recorded on the voter-marked paper ballot.

24. The system of claim 23, wherein the voter interface module is further configured to prompt the voter to provide confirmation for the write-in vote and receive confirmation of the write-in vote; and wherein the cast vote record includes write-in vote confirmation information.

25. The method of claim 23, wherein voter interface module is further configured to prompt the voter to provide a write-in candidate name.

26. The system of claim 18, wherein the paper ballot comprises a plurality of voter selection areas, and the vote processing module is further configured to perform a pixel count of each voter selection area, the pixel count identifying a number of pixels in the optical image that contain a voter marking.

27. The system of claim 18, wherein the vote record generation module is further configured to generate a vote mark comprising the one or more votes recorded on the voter-marked paper ballot and any clarification for one or more votes received from the voter.

28. The system of claim 27, wherein the vote record generation module is further configured to append an optical image of the vote mark to the optical image of the voter-marked paper ballot.

29. The system of claim 18, further comprising:

a network interface coupled with the vote record generation module and configured to transmit the cast vote record to a remote system.

30. A computer program product, comprising:

a non-transitory computer-readable medium comprising:

code for receiving an optical image of the voter-marked paper ballot;

code for analyzing the optical image to determine that one or more votes recorded on the voter-marked paper ballot satisfy a criteria for voter clarification;

code for prompting the voter on a voter interface to provide clarification for one or more votes recorded on the voter-marked paper ballot when one or more votes satisfy the voter clarification criteria;

code for receiving clarification via the voter interface for one or more votes from the voter responsive to the prompting, wherein the clarification comprises at least one of corrections, or modifications, of the voter-marked paper ballot; and code for generating a cast vote record responsive to the analyzing and receiving clarification.

31. The computer program product of claim 30, wherein the computer readable medium further comprises:

code for printing, on the voter-marked paper ballot, a record of the clarification received from the voter.

32. The computer program product of claim 31, wherein the computer readable medium further comprises:

code for receiving a second optical image of the corrected voter-marked paper ballot.

33. The computer program product of claim 30, wherein the computer readable medium further comprises:

code for generating a vote mark comprising the one or more votes recorded on the voter-marked paper ballot and any clarification for one or more votes received from the voter.

34. The computer program product of claim 33, wherein the computer readable medium further comprises:

code for appending an optical image of the vote mark to the optical image of the voter-marked paper ballot.

35. The computer program product of claim 30, wherein the computer readable medium further comprises:

code for transmitting the cast vote record to a central server computer system.

36. The computer program product of claim 30, wherein the computer readable medium further comprises:

code for transmitting the optical image of the voter-marked paper ballot and the cast vote record to a central server computer system.

37. The computer program product of claim 30, wherein the voter-marked paper ballot comprises a plurality of voter selection areas, and the code for analyzing the optical image further comprises:

code for determining that one or more voter selection areas have been selected when markings in the one or more voter selection areas meet a predefined first criteria for determining a specific voter selection area has been selected; and code for determining that one or more votes recorded on the voter-marked paper ballot satisfy the criteria for voter clarification when markings in one or more voter selection areas meet a predefined second criteria for determining that it is ambiguous whether the one or more voter selection areas has been selected.

38. The computer program product of claim 37, wherein the predefined second criteria comprises a range of pixel counts between a minimum pixel count that is to be classified as a non-vote and a minimum pixel count that is to be classified as a vote.

* * * * *